US011998130B2

(12) United States Patent
Ruiz Ruiz

(10) Patent No.: US 11,998,130 B2
(45) Date of Patent: Jun. 4, 2024

(54) STAIRCASE CARPET STRETCHER

(71) Applicant: Ruben Ruiz Ruiz, Minneapolis, MN (US)

(72) Inventor: Ruben Ruiz Ruiz, Minneapolis, MN (US)

( * ) Notice: Subject to any disclaimer, the term of this patent is extended or adjusted under 35 U.S.C. 154(b) by 0 days.

(21) Appl. No.: 17/968,629

(22) Filed: Oct. 18, 2022

(65) Prior Publication Data

US 2023/0117188 A1 Apr. 20, 2023

Related U.S. Application Data

(60) Provisional application No. 63/256,906, filed on Oct. 18, 2021.

(51) Int. Cl.
*A47G 27/04* (2006.01)
*A47G 27/06* (2006.01)

(52) U.S. Cl.
CPC ..... *A47G 27/0493* (2013.01); *A47G 27/06* (2013.01)

(58) Field of Classification Search
CPC ..... A47G 27/0487; A47G 27/0493
See application file for complete search history.

(56) References Cited

U.S. PATENT DOCUMENTS 3,599,936 A * 8/1971 Crain, Jr. ..... A47G 27/0493 254/212
3,977,651 A * 8/1976 Chamberlain ..... A47G 27/0493 254/201
6,491,284 B1 * 12/2002 Jolly ..... A47G 27/0493 254/209
7,740,231 B2 * 6/2010 Winston, Jr. ..... A47G 27/0493 294/8.6
2021/0169258 A1 * 6/2021 Wipf ..... A47G 27/0493

FOREIGN PATENT DOCUMENTS

GB 2205742 A * 12/1988 ..... A47G 27/0493

* cited by examiner

*Primary Examiner* — Sang K Kim
*Assistant Examiner* — Nathaniel L Adams
(74) *Attorney, Agent, or Firm* — The Iwashko Law Firm, PLLC; Lev Ivan Gabriel Iwashko

(57) ABSTRACT

A staircase carpet stretcher, including a frame assembly, a manipulation assembly springingly connected to at least a portion of the frame assembly to facilitate gripping thereof, a first stretch bar assembly removably connected at a first end of the frame assembly to connect to a carpet of a staircase and move in response to compression of the manipulation assembly, and a second stretch bar assembly removably connected at a second end of the frame assembly to connect to the carpet and prevent movement of the frame assembly on the carpet.

7 Claims, 1 Drawing Sheet

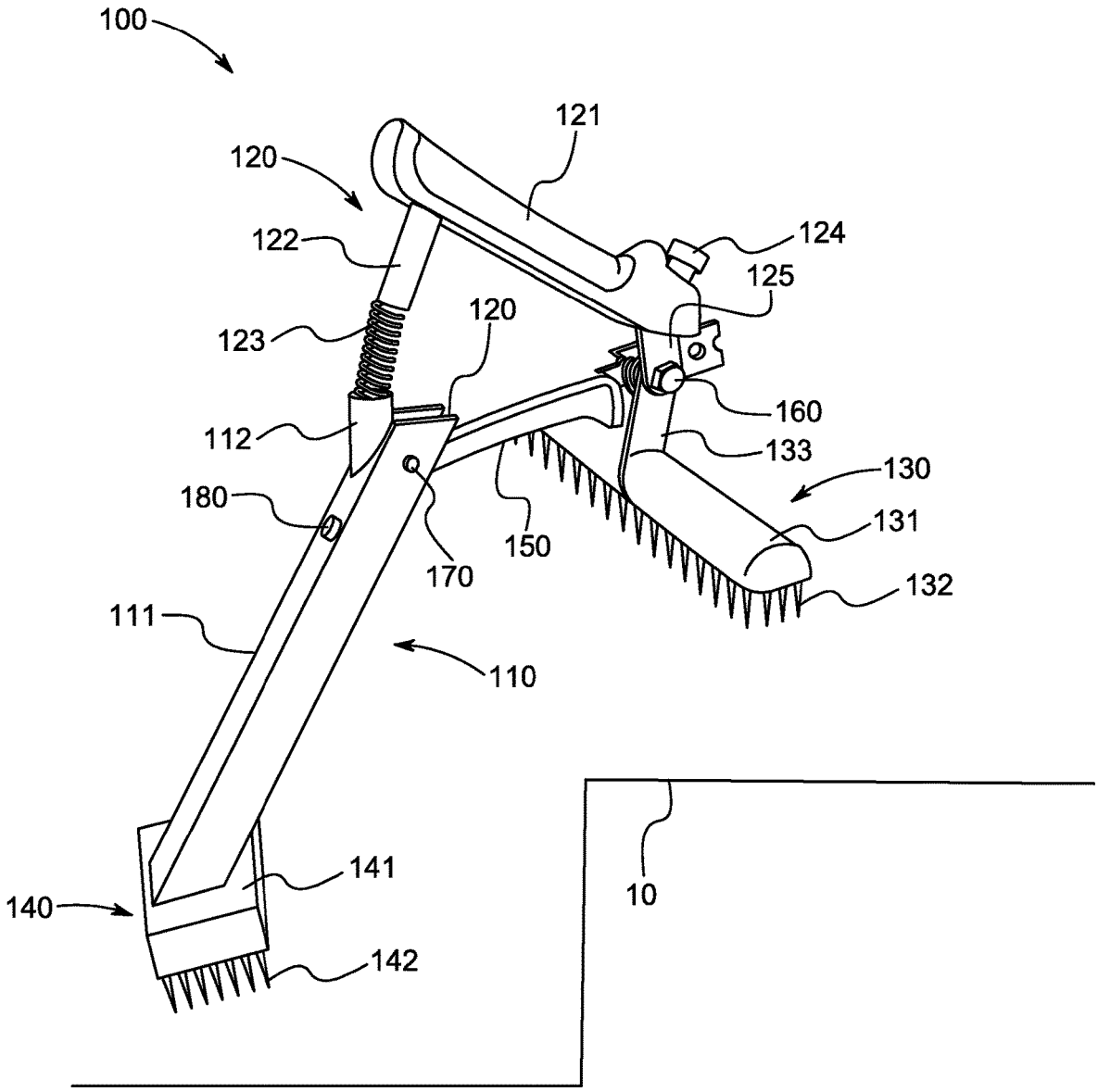
100
120
121
122
124
125
123
120
160
112
133
130
180
131
150
170
132
111
110
141
10
140
142

STAIRCASE CARPET STRETCHER

CROSS REFERENCE TO RELATED APPLICATION

This application claims the benefit of, and incorporates by reference, U.S. provisional patent application Ser. No. 63/256,906, entitled "Staircase Carpet Stretcher," which was filed on Oct. 18, 2021.

BACKGROUND

1. Field

The present general inventive concept relates generally to a carpet stretcher, and particularly, to a staircase carpet stretcher.

2. Description of the Related Art

Installing a carpet on a staircase requires heavy labor and can be an incredibly time consuming, difficult job to perform. Furthermore, an improper carpet installation can lead to wrinkling of the carpet, resulting in an uneven distribution of the carpet and preventing a smooth aesthetically pleasing finish.

Typically, a carpet stretcher requires a knee of a user to strike a cushioned surface. Additionally, the carpet stretcher includes a carpet spike that connects to the carpet. The carpet spike pulls the carpet in response to striking of the cushioned surface with the knee of the user. The repeated application of force with the knee can be tiring.

Therefore, there is a need for a staircase carpet stretcher that facilitates installing the carpet on the staircase without using the knee of the user.

SUMMARY

The present general inventive concept provides a staircase carpet stretcher.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a staircase carpet stretcher, including a frame assembly, a manipulation assembly springingly connected to at least a portion of the frame assembly to facilitate gripping thereof, a first stretch bar assembly removably connected at a first end of the frame assembly to connect to a carpet of a staircase and move in response to compression of the manipulation assembly, and a second stretch bar assembly removably connected at a second end of the frame assembly to connect to the carpet and prevent movement of the frame assembly on the carpet.

The frame assembly may include a main frame, and a spring receiving portion disposed on at least a portion of the main frame.

The manipulation assembly may include a handle to facilitate gripping thereof, a spring connector perpendicularly disposed away from a first end of the handle with respect to a direction, and a spring connected at a first end to the spring connector and connected at a second end within the spring receiving portion to compress in response to compressing the handle, such that the first stretch bar assembly moves in a lateral direction away from the main frame.

The manipulation assembly may further include a tension adjuster movably disposed on at least a portion of a second end of the handle to decrease a height of the handle in response to rotating in a first direction, and increase the height of the handle in response to rotating in a second direction, and a handle connector disposed on at least a portion of the second end of the handle to connect the handle to the first stretch bar assembly.

The first stretch bar assembly may include a first lateral bar disposed on at least a portion of the manipulation assembly, and a plurality of first carpet spikes perpendicularly disposed away from the first lateral bar with respect to a vertical direction to connect to the carpet.

Each of the plurality of first carpet spikes may be removably connected to the first lateral bar.

The second stretch bar assembly may include a second lateral bar disposed on at least a portion of the frame assembly, and a plurality of second carpet spikes perpendicularly disposed away from the second lateral bar with respect to a vertical direction to connect to the carpet.

The first stretch bar assembly may be disposed on a first plane on the staircase and the second stretch bar assembly is disposed on a second plane on the staircase, such that the first plane is different from the second plane.

The staircase carpet stretcher may further include a compression rod removably connected at a first end to the frame assembly and removably connected at a second end to the manipulation assembly and the first stretch bar assembly to apply an application of force against the first stretch bar assembly in response to compressing the manipulation assembly.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a side perspective view of a staircase carpet stretcher, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Staircase Carpet Stretcher 100
Frame Assembly 110
Main Frame 111
Spring Receiving Portion 112
Rod Receiving Groove 113
Manipulation Assembly 120
Handle 121
Spring Connector 122
Spring 123
Tension Adjuster 124
Handle Connector 125
First Stretch Bar Assembly 130
First Lateral Bar 131
First Carpet Spikes 132
Bar Connector 133
Second Stretch Bar Assembly 140
Second Lateral Bar 141
Second Carpet Spikes 142
Compression Rod 150
Connector Fastener 160
Frame Fastener 170
Lateral Bar Button 180

FIG. 1 illustrates a side perspective view of a staircase carpet stretcher 100, according to an exemplary embodiment of the present general inventive concept.

The staircase carpet stretcher 100 may be constructed from at least one of metal, plastic, wood, and rubber, etc., but is not limited thereto.

The staircase carpet stretcher 100 may include a frame assembly 110, a manipulation assembly 120, a first stretch bar assembly 130, a second stretch bar assembly 140, a compression rod 150, a connector fastener 160, a frame fastener 170, and a lateral bar button 180, but is not limited thereto.

The frame assembly 110 may include a main frame 111, a spring receiving portion 112, and a rod receiving groove 113, but is not limited thereto.

Referring to FIG. 1, the main frame 111 is illustrated to have a trapezoidal shape. However, the main frame 111 may be rectangular, circular, conical, triangular, pentagonal, hexagonal, heptagonal, octagonal, or any other shape known to one of ordinary skill in the art, but is not limited thereto. In this case, the trapezoidal shape provides an advantage due to extending at an angle with respect to a horizontal plane. In particular, the trapezoidal shape may be similar to an elevation and slope of a staircase.

The spring receiving portion 112 may be disposed on at least a portion of a first end of the main frame 111. Moreover, the spring receiving portion 112 may have a cylindrical shape.

The rod receiving groove 113 may be disposed on at least a portion of the first end of the main frame 111 and adjacent to the spring receiving portion 112.

The manipulation assembly 120 may include a handle 121, a spring connector 122, a spring 123, a tension adjuster 124, and a handle connector 125, but is not limited thereto.

The handle 121 may facilitate gripping thereof. The spring connector 122 may be perpendicularly disposed away from a first end of the handle 121 with respect to a direction. Additionally, the spring 123 may be connected at a first end to the spring connector 122 and connected at a second end within the spring receiving portion 112. In other words, the spring receiving portion 112 may receive the second end of the spring 123 therein.

The tension adjuster 124 may be movably (i.e. rotatably) disposed on at least a portion of a second end of the handle 121. The handle connector 125 may be disposed on at least a portion of the second end of the handle 121. The tension adjuster 124 may rotate in a first direction (i.e. clockwise) or a second direction (i.e. counterclockwise) to decrease a height of the handle 121 with respect to the handle connector 125. Alternatively, the tension adjuster 124 may rotate in the second direction or the first direction to increase the height of the handle 121 with respect to the handle connector 125.

The first stretch bar assembly 130 may include a first lateral bar 131, a plurality of first carpet spikes 132, and a bar connector 133, but is not limited thereto.

The first lateral bar 131 may be disposed on at least a portion of the handle connector 125.

The plurality of first carpet spikes 132 may be perpendicularly disposed away from the first lateral bar 131 with respect to a vertical direction. Also, the plurality of first carpet spikes 132 may be removably disposed on at least a portion of the first lateral bar 131, such that the plurality of first carpet spikes 132 may be exchanged and/or replaced. Furthermore, the plurality of first carpet spikes 132 may extend and/or connect to a carpet 10 on the staircase. As such, the carpet 10 may move in response to movement of the first lateral bar 131.

The bar connector 133 may be removably connected to at least a portion of the handle connector 125. Moreover, the handle connector 125 may move (i.e. pivot) with respect to the bar connector 133.

The second stretch bar assembly 140 may include a second lateral bar 141 and a plurality of second carpet spikes 142, but is not limited thereto.

The second lateral bar 141 may be removably connected to at least a portion of a second end of the main frame 111.

The plurality of second carpet spikes 142 may be perpendicularly disposed away from the second lateral bar 141 with respect to the vertical direction. Also, the plurality of second carpet spikes 142 may be removably disposed on at least a portion of the second lateral bar 141, such that the plurality of second carpet spikes 142 may be exchanged and/or replaced. Furthermore, the plurality of second carpet spikes 142 may extend and/or connect to the carpet 10 on the staircase.

The compression rod 150 may include a fixed rod and a hydraulic piston, but is not limited thereto.

The compression rod 150 may be removably connected at a first end to the rod receiving groove 113 and removably connected at a second end to the handle connector 125 and/or the bar connector 133.

The connector fastener 160 may include a screw, a nail, a bolt, a pin, a peg, a rivet, a threaded insert, a threaded rod, a washer, a nut, and/or any combination thereof, but is not limited thereto.

The connector fastener 160 may removably connect the handle connector 125, the bar connector 133, and/or the compression rod 150 to each other.

The frame fastener 170 may include a screw, a nail, a bolt, a pin, a peg, a rivet, a threaded insert, a threaded rod, a washer, a nut, and/or any combination thereof, but is not limited thereto.

The frame fastener 170 may removably connect the main frame 111 to the compression rod 150. More specifically, the frame fastener 170 may removably connect the compression rod 150 within the rod receiving groove 113 of the main frame 111.

The lateral bar button 180 may be disposed on at least a portion of the main frame 111. The lateral bar button 180 may be depressed to detach the second stretch bar assembly 140 from the main frame 111.

In operation, the first lateral bar 131 and/or the plurality of first carpet spikes 132 may be disposed on a first portion of the carpet 10 on a first plane of the staircase. The second lateral bar 141 and/or the plurality of second carpet spikes 142 may be disposed on a second portion of the carpet 10 on a second plane of the staircase different with respect to the first plane. Also, the first lateral bar 131 and/or the plurality of first carpet spikes 132 may be disposed at a higher elevation than the second lateral bar 141 and/or the plurality of second carpet spikes 142. In other words, the first lateral bar 131 and/or the plurality of first carpet spikes 132 may be disposed on a first step at a higher position than the second lateral bar 141 and/or the plurality of second carpet spikes 142 disposed on a second step at a lower position.

The handle 121 may be depressed to compress the spring 123 via the spring connector 122. The movement of the handle 121 may rotate the handle connector 125, such that the lateral bar 131 and/or the plurality of first carpet spikes 132 may move in a lateral direction away from the main frame 111.

As such, the carpet 10 may move in response to movement of the first lateral bar 131 and/or the plurality of first carpet spikes 132. Also, the movement of the handle 121 to compress the spring 123 may direct a force against the compression rod 150 that moves the first lateral bar 131 and/or the plurality of first carpet spikes 132. The compression rod 150 may use the hydraulic piston to provide a gradual movement of the first lateral bar 131 and/or the plurality of first carpet spikes 132, instead of the fixed rod which provides a reciprocal transfer of motion (i.e. instant) from the main frame 111 to the first lateral bar 131 and/or the plurality of first carpet spikes 132. Furthermore, the second lateral bar 141 and/or the plurality of second carpet spikes 142 may stabilize the main frame 111, such that plurality of second carpet spikes 142 may prevent movement on the carpet 10.

Accordingly, the first lateral bar 131 and/or the plurality of first carpet spikes 132 may move in the lateral direction away from the main frame 111 in response to depressing the handle 121.

Therefore, the staircase carpet stretcher 100 may facilitate installation of the carpet 10 on the staircase using only a hand of a user.

The present general inventive concept may include a staircase carpet stretcher 100, including a frame assembly 110, a manipulation assembly 120 springingly connected to at least a portion of the frame assembly 110 to facilitate gripping thereof, a first stretch bar assembly 130 removably connected at a first end of the frame assembly 110 to connect to a carpet 10 of a staircase and move in response to compression of the manipulation assembly 120, and a second stretch bar assembly 140 removably connected at a second end of the frame assembly 110 to connect to the carpet 10 and prevent movement of the frame assembly 110 on the carpet 10.

The frame assembly 110 may include a main frame 111, and a spring receiving portion 112 disposed on at least a portion of the main frame 111.

The manipulation assembly 120 may include a handle 121 to facilitate gripping thereof, a spring connector 122 perpendicularly disposed away from a first end of the handle 121 with respect to a direction, and a spring 123 connected at a first end to the spring connector 122 and connected at a second end within the spring receiving portion 112 to compress in response to compressing the handle 121, such that the first stretch bar assembly 130 moves in a lateral direction away from the main frame 110.

The manipulation assembly 120 may further include a tension adjuster 124 movably disposed on at least a portion of a second end of the handle 121 to decrease a height of the handle 121 in response to rotating in a first direction, and increase the height of the handle 121 in response to rotating in a second direction, and a handle connector 125 disposed on at least a portion of the second end of the handle 121 to connect the handle 121 to the first stretch bar assembly 130.

The first stretch bar assembly 130 may include a first lateral bar 131 disposed on at least a portion of the manipulation assembly 120, and a plurality of first carpet spikes 132 perpendicularly disposed away from the first lateral bar 131 with respect to a vertical direction to connect to the carpet 10.

Each of the plurality of first carpet spikes 132 may be removably connected to the first lateral bar 131.

The second stretch bar assembly 140 may include a second lateral bar 141 disposed on at least a portion of the frame assembly 110, and a plurality of second carpet spikes 142 perpendicularly disposed away from the second lateral bar 141 with respect to a vertical direction to connect to the carpet 10.

The first stretch bar 130 assembly may be disposed on a first plane on the staircase and the second stretch bar assembly is disposed on a second plane on the staircase, such that the first plane is different from the second plane.

The staircase carpet stretcher 100 may further include a compression rod 150 removably connected at a first end to the frame assembly 110 and removably connected at a second end to the manipulation assembly 120 and the first stretch bar assembly 130 to apply an application of force against the first stretch bar assembly 130 in response to compressing the manipulation assembly 120.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A staircase carpet stretcher, comprising:

a frame assembly, comprising:

a main frame, and a spring receiving portion disposed on at least a portion of the main frame;

a manipulation assembly springingly connected to at least a portion of the frame assembly to facilitate gripping thereof;

a first stretch bar assembly removably connected at a first end of the frame assembly to connect to a carpet of a staircase and move in response to compression of the manipulation assembly; and a second stretch bar assembly removably connected at a second end of the frame assembly to connect to the carpet and prevent movement of the frame assembly on the carpet, wherein the manipulation assembly comprises:

a handle to facilitate gripping thereof, a spring connector perpendicularly disposed away from a first end of the handle with respect to a direction, and a spring connected at a first end to the spring connector and connected at a second end within the spring receiving portion to compress in response to compressing the handle, such that the first stretch bar assembly moves in a lateral direction away from the main frame.

2. The staircase carpet stretcher of claim 1, wherein the manipulation assembly further comprises:

a tension adjuster movably disposed on at least a portion of a second end of the handle to decrease a height of the handle in response to rotating in a first direction, and increase the height of the handle in response to rotating in a second direction; and a handle connector disposed on at least a portion of the second end of the handle to connect the handle to the first stretch bar assembly.

3. The staircase carpet stretcher of claim 1, wherein the first stretch bar assembly comprises:

a first lateral bar disposed on at least a portion of the manipulation assembly; and a plurality of first carpet spikes perpendicularly disposed away from the first lateral bar with respect to a vertical direction to connect to the carpet.

4. The staircase carpet stretcher of claim 3, wherein each of the plurality of first carpet spikes is removably connected to the first lateral bar.

5. The staircase carpet stretcher of claim 1, wherein the second stretch bar assembly comprises:

a second lateral bar disposed on at least a portion of the frame assembly; and a plurality of second carpet spikes perpendicularly disposed away from the second lateral bar with respect to a vertical direction to connect to the carpet.

6. The staircase carpet stretcher of claim 1, wherein the first stretch bar assembly is disposed on a first plane on the staircase and the second stretch bar assembly is disposed on a second plane on the staircase, such that the first plane is different from the second plane.

7. The staircase carpet stretcher of claim 1, further comprising:

a compression rod removably connected at a first end to the frame assembly and removably connected at a second end to the manipulation assembly and the first stretch bar assembly to apply an application of force against the first stretch bar assembly in response to compressing the manipulation assembly.

* * * * *